United States Patent [19]

Taylor

[11] 4,445,308

[45] May 1, 1984

[54] REINFORCEMENT SUPPORTS

[75] Inventor: Leonard G. Taylor, St. Martins, New Zealand

[73] Assignee: Allied Steel and Wire Limited, Cardiff, Wales

[21] Appl. No.: 339,656

[22] Filed: Jan. 8, 1982

Related U.S. Application Data

[63] Continuation of Ser. No. 134,006, Mar. 26, 1980, abandoned.

[30] Foreign Application Priority Data

Mar. 26, 1979 [NZ] New Zealand ..... 190004
Mar. 27, 1979 [NZ] New Zealand ..... 191391

[51] Int. Cl.[3] ..... E04C 5/16
[52] U.S. Cl. ..... 52/687; 52/684
[58] Field of Search ..... 52/687, 688, 689, 684, 52/685, 677, 678; 46/29; 160/135

[56] References Cited

U.S. PATENT DOCUMENTS 4,063,585 12/1977 Stanley ..... 160/135
4,069,832 1/1978 Bingham ..... 52/648
4,219,958 9/1980 Shulyak ..... 46/29

FOREIGN PATENT DOCUMENTS 1259078 1/1968 Fed. Rep. of Germany ..... 52/677
2209277 8/1973 Fed. Rep. of Germany ..... 52/677
6710469 10/1968 Netherlands ..... 52/689
1434054 4/1976 United Kingdom ..... 52/689

*Primary Examiner*—Henry E. Raduazo
*Attorney, Agent, or Firm*—Merriam, Marshall & Bicknell

[57] ABSTRACT

A support for maintaining concrete reinforcement at a pre-determined level during the pouring of concrete there around comprises an assembly of at least a pair of adjacent inverted 'U' shaped metal yokes 10. Each yoke comprises a pair of spaced substantially parallel limbs 12 interconnected by a bridge element 14 and adjacent limbs of adjacent yokes of the assembly are frictionally connected together by intermediate couplings 16 and foot connectors 18 whereby the angle between adjacent yokes may be initially pre-selected and thereafter frictionally maintained.

14 Claims, 7 Drawing Figures

FIG. 4.
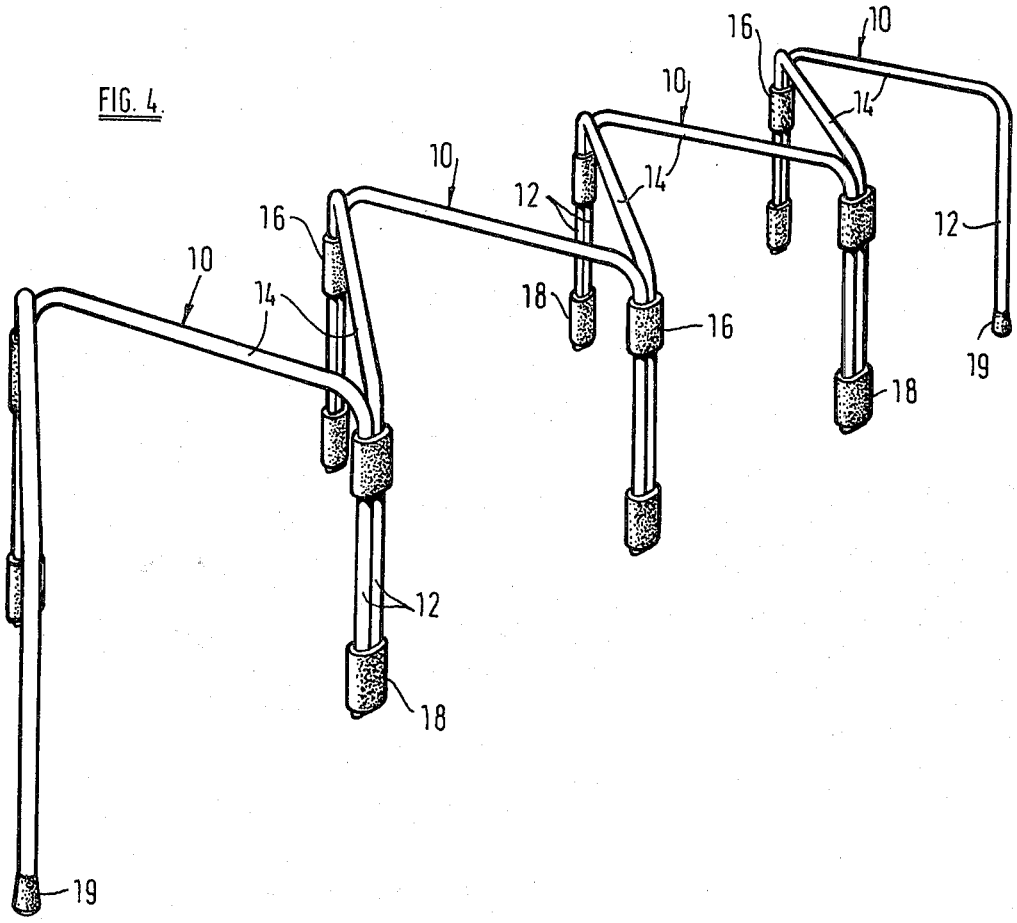
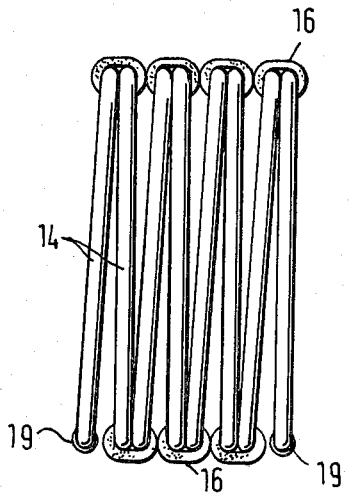
FIG. 5.

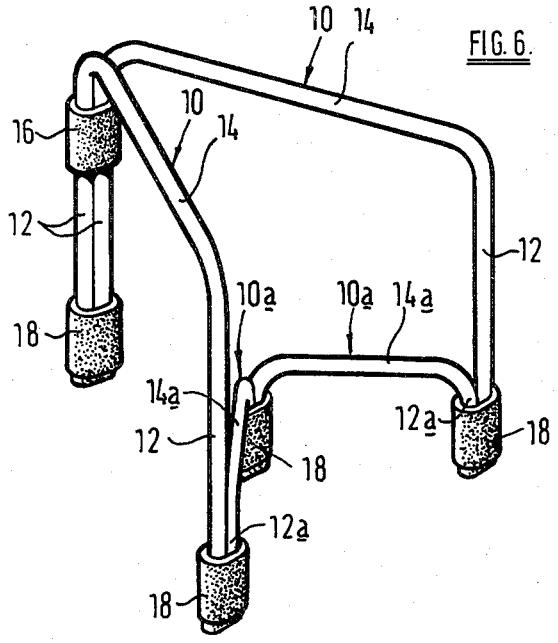
FIG. 6.
FIG. 7.
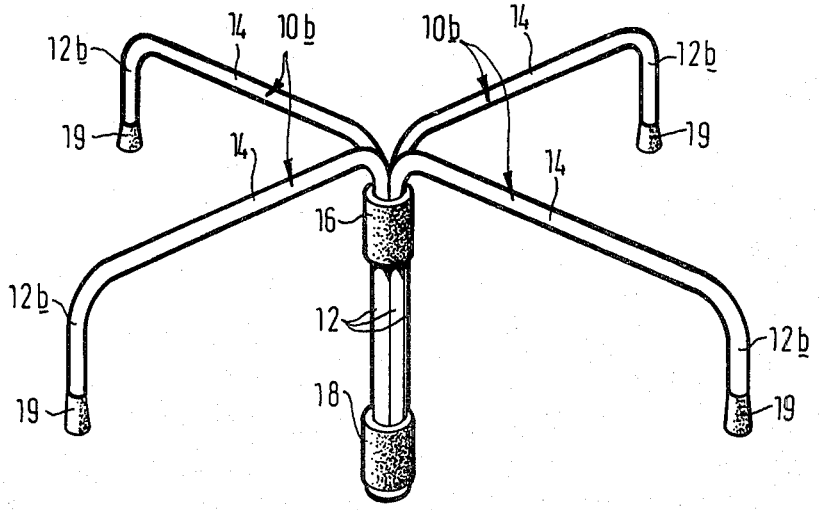

REINFORCEMENT SUPPORTS

This is a continuation, of application Ser. No. 134,006, filed Mar. 26, 1980 and now abandoned.

BACKGROUND OF THE INVENTION

This invention relates to supports for maintaining reinforcement, such as bar or mesh, at a pre-determined level in concrete structures prior to, and during, the pouring of the concrete around the supports and reinforcements.

Supports for this purpose have already been proposed. For example in British Pat. No. 1434054 various shapes of support or spacer are disclosed wherein the supports comprise assemblies of inverted 'U' shaped yokes. Adjacent such 'U' shaped yokes are described principally as being welded together to give rigidity to the assembly although there is also described an assembly wherein adjacent yokes are connected only at their feet, i.e. at the lower-most extremities of the adjacent vertical limbs of each inverted 'U' shaped yoke. As described in the said patent such foot connectors take the form of 'U' shaped staples fitted into the hollow adjacent feet of adjacent yokes, the yokes in such an arrangement being formed of tubular material. However it is evident in such an arrangement that the adjacent verticle limbs of adjacent yokes may tend to splay apart and indeed, it is clear that the said patent is primarily concerned with spot welding adjacent limbs of adjacent yokes together at vertically spaced positions in order to enhance the rigidity of the assembly.

Welded assemblies of inverted 'U' shaped yokes are of necessity awkward to handle and transport, and bent configurations of support made from a continuous length of wire or rod would be similarly bulky and awkward.

SUMMARY OF THE INVENTION

It is an object of the present invention to provide a support for concrete reinforcement which will overcome the disadvantages associated with prior proposals in this field.

In accordance with the broadest aspect of the invention there is provided a support for maintaining concrete reinforcement at a pre-determined level during the pouring of concrete therearound comprising an assembly of a pair of adjacent inverted 'U' shaped metal yokes, each yoke having a pair of spaced substantially parallel limbs inter-connected by a bridge, with two adjacent limbs of the two adjacent yokes connected together characterized in that the two adjacent limbs are connected intermediate their ends by an encircling coupling frictionally engaging both limbs whereby the angle between the two yokes may be initially preselected and thereafter frictionally maintained by the said coupling during the pouring of concrete around said support and the reinforcement carried thereon.

Such an assembly may comprise more than two inverted 'U' shaped metal yokes arrangeable in a zig-zag configuration with the adjacent limbs of the adjacent yokes of the assembly connected together by a said encircling coupling frictionally engaging said adjacent limbs of adjacent yokes.

Alternatively the assembly may comprise more than two inverted 'U' shaped metal yokes arrangeable in a closed multi-leg configuration with each leg comprising two adjacent limbs of two adjacent yokes; the two adjacent limbs comprising one of the legs being connected together intermediate their ends by a 'U' shaped coupling frictionally engaging said adjacent limbs of said one leg and the pairs of adjacent limbs comprising the remainder of the legs being connected together by a said encircling coupling frictionally engaging each said pair of limbs. Such an assembly may comprise three inverted 'U' shaped metal yokes arrangeable in a tripod configuration with each leg of the tripod comprising two adjacent limbs of two adjacent yokes; the two pairs of adjacent limbs comprising two of the tripod legs each being connected together by a said encircling coupling frictionally engaging each said pair of adjacent limbs and the adjacent limbs of the third tripod leg being connected together intermediate their ends by a 'U' shaped coupling frictionally engaging said adjacent limbs of the third tripod leg.

At least one of the 'U' shaped yokes may have its limbs of a different length to the limbs of the other yoke or yokes of the assembly whereby differing levels of bridge are provided. Reinforcement may thus be carried at different levels by a plurality of such supports. Thus in one preferred closed multi-leg configuration there may be provided a first pair of adjacent yokes having limbs of the same length and a further pair of adjacent yokes having limbs shorter than the limbs of the first pair of yokes; a limb of each yoke of the first pair being connected to a limb of each yoke of the further pair.

In a further alternative arrangement of yokes forming the support more than two adjacent limbs of adjacent yokes may be frictionally connected together to form a common central leg of the support. In such an arrangement it may be desirable, when using the support in formwork concreting, to provide for example four yokes in each support with four adjacent limbs of the four yokes frictionally connected together by an encircling coupling so that the yokes provide a cruciform assembly with the free limbs of each yoke of a shorter length than the adjacent limbs forming the common leg.

The feet of that pair of adjacent limbs which are connected together by said 'U' shaped coupling are conveniently connected together by a 'U' shaped foot connector frictionally engaging both feet and providing a base therefor whilst the feet of the remaining adjacent limbs are conveniently connected together by an encircling foot connector frictionally engaging both feet and also providing a base therefor. The encircling couplings, the 'U' shaped couplings and the foot connectors are all conveniently formed of plastics material. Each said yoke is preferably formed of steel rod.

BRIEF DESCRIPTION OF THE DRAWINGS

Other features of the invention will become apparent from the following description given herein solely by way of example with reference to the accompanying drawings wherein like reference numerals refer to like parts throughout the several views and wherein

FIG. 4 is a perspective view of a further embodiment of support according to the invention wherein the yokes are arranged in a zig-zag configuration;

FIG. 5 is a plan view of the assembly of FIG. 4 folded for transportation.

FIG. 6 is a perspective view of a multi-leg configuration of support; and

FIG. 7 is a perspective view of a cruciform support made of four yokes.

DESCRIPTION OF PREFERRED EMBODIMENTS

Figure 1:
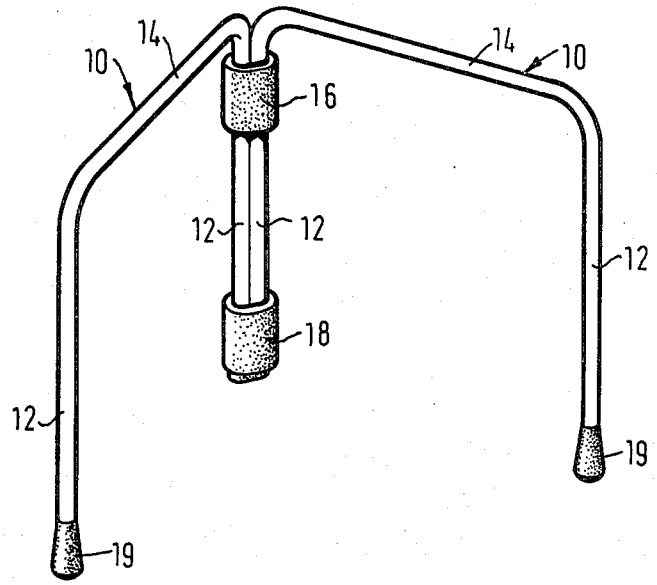
FIG. 1 is a perspective view of a reinforcement support forming a first embodiment of the invention.

A support for concrete reinforcement in accordance with the broadest aspect of the invention is shown in FIG. 1 of the drawings. Such support comprises an assembly of a pair of adjacent inverted 'U' shaped metal yokes 10 with each yoke having a pair of spaced parallel limbs 12 interconnected by a bridge element 14. Each yoke is formed from an integral length of steel rod typically of 5 mm dia. As illustrated, two adjacent limbs 12 of the two yokes are connected together intermediate their ends by a coupling 16 and at their feet by a foot connector 18.

The coupling 16 is formed of a plastics material and comprises an encircling coupling frictionally engaging both limbs 12 whilst the foot connector 18 frictionally engages with and encircles the feet of the two adjacent limbs 12 and provides a base therefor. The feet of the free limbs of the two yokes are provided with further plastics feet 19. The provision of a frictionally engaging couping 16, together with the foot connector 18, enables the angle between the two yokes to be initially pre-selected and thereafter frictionally maintained during the pouring of concrete around the support and the reinforcement carried on the bridge elements 14 thereof. Thus in use a plurality of supports would be arranged on the site to be concreted with the bridge elements 14 of the two yokes of each support typically splayed apart at an angle of 45 degrees. Reinforcing bar or mesh is then laid on the bridge elements 14 whereby the reinforcement is maintained by the supports at a pre-determined level durng the pouring of concrete there around. The tight frictional engagement of the coupling 16 and the foot connector 18 with the limbs prevent displacement of the two yokes of each assembly relative to one another during the pouring of the concrete.

Figure 2:
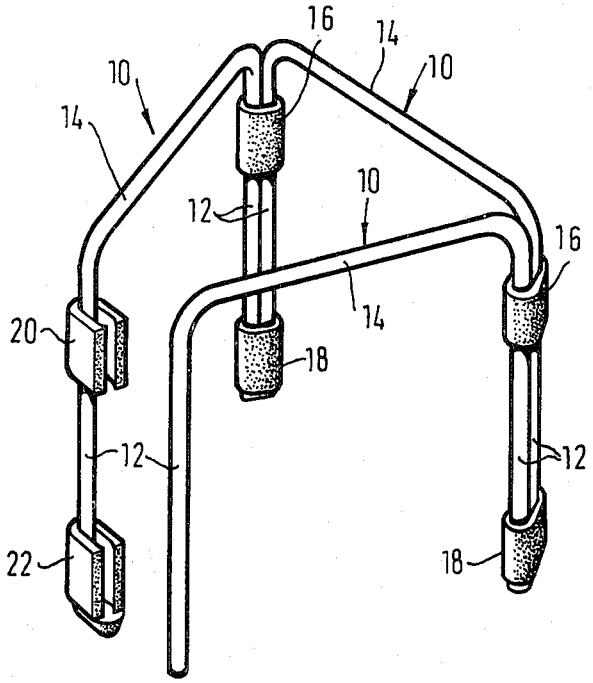
FIG. 2 is a perspective view of a further embodiment of a support in accordance with the invention comprising three yokes arranged in a tripod configuration with the two adjacent limbs of one of the tripod legs disconnected from one another.

A more rigid assembly is shown in FIG. 2 of the drawings wherein three of the inverted 'U' shaped yokes are arranged in a tripod configuration with couplings 16 and foot connectors 18 securing two pairs of adjacent limbs together to form two legs of the tripod. As shown in the drawings for the purposes of clarity the third leg of the tripod is not completed but is illustrated thus to show a 'U' shaped coupling 20 and 'U' shaped foot connector 22 for the third leg. The 'U' shaped connector 20 and 'U' shaped foot connector 22 are formed of plastics material and are similar to the coupling 16 and connector 18 but, as will be appreciated, are provided with an open mouth whereby the final two adjacent limbs of the tripod assembly may be brought together to form the third leg of the tripod. Such a tripod assembly thus has two yoke limbs 12 comprising each leg and is secured together in a relatively rigid manner to give good stability to the assembly for supporting the reinforcement during the pouring of concrete around the support and the reinforcement carried thereon.

Figure 3:
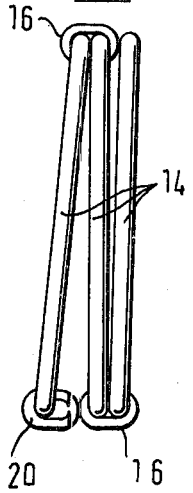
FIG. 3 is a plan view of the support of FIG. 2 folded for transportation.

FIG. 3 of the drawings illustrates a most advantageous feature of the invention in that the yokes forming the support assemblies may be folded one on top of another for ease of transportation and handling prior to erection of the assembly at the site.

Although a tripod assembly is shown in FIGS. 2 and 3 it will be appreciated that more than three inverted 'U' shaped yokes may be arrangeable into a closed multi-leg configuration with each leg comprising two adjacent limbs of two adjacent yokes.

In FIG. 4 of the drawings there is shown a further alternative embodiment of support assembly wherein a plurality of adjacent yokes are arranged in a zig-zag configuration with adjacent limbs of adjacent yokes of the assembly connected together by the encircling frictional couplings 16 and encircling frictional foot connectors 18. FIG. 5 of the drawing shows the assembly of FIG. 4 folded for transportation prior to its erection on site.

As illustrated in FIG. 6 of the drawings a closed multi-leg configuration of support is provided with a first pair of yokes 10 having limbs 12 of the same length connected to a further pair of yokes **10*a* having limbs 12*a* of shorter length than the limbs 12. The bridge elements 14*a* of the yokes 10*a* are thus provided at a lower level than the bridge elements 14** whereby reinforcement may be carried at differing levels by a plurality of such supports. It will be appreciated that any number of levels of bridge element may be provided in a support having a plurality of yokes either in an open configuration of the type shown in FIGS. 1 and 4 or in the closed configuration of the type shown in FIGS. 2 and 6.

In FIG. 7 of the drawings there is illustrated an assembly of four yokes **10*b* providing, in perspective view, a cruciform support particularly suitable for use in formwork concreting. Four adjacent limbs 12 are connected together by the frictional coupling 16 to provide a common central leg locatable in the groove between adjacent formwork moulds. Each yoke is thus provided with a free limb 12*b* which, in this particular application, is shorter than the limbs 12 so that the feet of the shorter limbs 12*b*** may rest on the bases of the formwork moulds for supporting reinforcing rod or mesh above the bases of the moulds.

I claim:

1. A support for maintaining concrete reinforcement at a predetermined level during the pouring of concrete therearound comprising an assembly of two adjacent inverted 'U' shaped metal yokes, each yoke having a pair of substantially parallel and vertical limbs and a bridge interconnecting the upper ends of the vertical limbs, and connection means interconnecting two adjacent limbs of the two adjacent yokes, characterized in that the interconnection means comprises two couplings mutually spaced along the limbs and each encircling and frictionally engaging both limbs whereby the two limbs are held positively in mutually parallel contacting relation to each other in a relatively rigid manner and the two yokes are angularly displaceable relative to each other about an axis passing through the couplings between a storage position in which the respective bridges are maintained substantially parallel to each other by the friction of said couplings and an operational position in which the respective bridges are maintained at an angle relative to each other by the friction of said couplings for the support of reinforcement thereon during the pouring of concrete around the support and reinforcement.

2. A support as claimed in claim 1 wherein said assembly comprises more than two inverted 'U' shaped metal yokes arrangeable in a zig-zag configuration with the adjacent limbs of the adjacent yokes of the assembly connected together by said encircling coupings frictionally engaging said adjacent limbs of adjacent yokes.

3. A support as claimed in claim 1 wherein said assembly comprises more than two inverted 'U' shaped metal yokes arrangeable in a closed multi-leg configuration with each leg comprising two adjacent limbs of two adjacent yokes.

4. A support as claimed in claim 1 wherein said assembly comprises more than two inverted 'U' shaped metal yokes arrangable in a closed multi-leg configuration with each leg comprising two adjacent limbs of two adjacent yokes, the two adjacent limbs comprising one of the legs being connected together intermediate their ends by two 'U' shaped couplings frictionally engaging said adjacent limbs of said one leg and the pairs of adjacent limbs comprising the remainder of the legs being connected together by two encircling coupings frictionally engaging each said pair of limbs.

5. A support as claimed in claim 3 wherein said assembly comprises three inverted 'U' shaped metal yokes arrangeable in a tripod configuration with each leg of the tripod comprising two adjacent limbs of two adjacent yokes; the two pairs of adjacent limbs comprising two of the tripod legs each being connected together by two encircling coupling frictionally engaging each said pair of adjacent limbs and the adjacent limbs of the third tripod leg being connected together intermediate their ends by a 'U' shaped couplings frictionally engaging said adjacent limbs of the third tripod leg.

6. A support as claimed in claim 1 wherein said assembly comprises more than two inverted 'U' shaped metal yokes with adjacent limbs of adjacent yokes connected together by two encircling coupling to provide a common central leg to the support.

7. A support as claimed in claim 1 wherein the limbs of one yoke are of a different height to the limbs of the other yoke of the support whereby the bridges are provided at different heights in the support and whereby reinforcement may be carried at differing levels thereon.

8. A support as claimed in claim 1 wherein one of said couplings between adjacent limbs is a foot connector frictionally engaging both feet of said limbs and providing a base therefor.

9. A support as claimed in claim 4 wherein one of said couplings between adjacent limbs which are connected together by said 'U' shaped couplings is a 'U' shaped foot connector frictionally engaging both feet of said limbs and providing a base therefor.

10. A support as claimed in claim 1 wherein said couplings are formed of a plastics material.

11. A support as claimed in claim 8 wherein said foot connector is formed of a plastics material.

12. A support as claimed in claim 1 wherein each said yoke is formed of steel rod.

13. A support for maintaining concrete reinforcement at a predetermined level during the pouring of concrete therearound comprising an assembly of two adjacent inverted 'U' shaped metal yokes, each yoke having a pair of substantially parallel and vertical limbs and a bridge interconnecting the upper ends of the vertical limbs, and connection means interconnecting two adjacent limbs of the two adjacent yokes, characterized in that the interconnection means comprises two couplings mutually spaced along the limbs and each frictionally engaging both limbs whereby the two limbs are held positively in mutually parallel contacting relation to each other in a relatively rigid manner and the two yokes are angularly displaceable relative to each other about an axis passing through the couplings between a storage position in which the respective bridges are maintained substantially parallel to each other by the friction of said couplings and an operational position in which the respective bridges are maintained at an angle relative to each other by the friction of said couplings for the support of reinforcement thereon during the pouring of concrete around the support and reinforcement.

14. A support for maintaining concrete reinforcement at a predetermined level during the pouring of concrete therearound comprising an assembly of two adjacent inverted 'U' shaped metal yokes, each yoke having a pair of substantially parallel and vertical limbs and a bridge interconnecting the upper ends of the vertical limbs, and connection means interconnecting two adjacent limbs of the two adjacent yokes, characterized in that the interconnection means comprises two couplings mutually spaced along the limbs and each frictionally engaging both limbs whereby the two limbs are held positively in mutually parallel adjacent relation to each other in a relatively rigid manner and the two yokes are angularly displaceable relative to each other about an axis passing through the couplings between a storage position in which the respective bridges are maintained substantially parallel to each other by the friction of said couplings and an operational position in which the respective bridges are maintained at an angle relative to each other by the friction of said couplings for the support of reinforcement thereon during the pouring of concrete around the support and reinforcement.

* * * * *